US007568429B2

(12) United States Patent
Hummel et al.

(10) Patent No.: US 7,568,429 B2
(45) Date of Patent: Aug. 4, 2009

(54) WIRELESS DETONATOR ASSEMBLY, AND METHODS OF BLASTING

(75) Inventors: Dirk Hummel, Hennef (DE); Michael J. McCann, Chadds Ford, PA (US); Ronald F. Stewart, Navan (CA)

(73) Assignee: Orica Explosives Technology Pty Ltd, Melbourne, Victoria (AU)

( * ) Notice: Subject to any disclaimer, the term of this patent is extended or adjusted under 35 U.S.C. 154(b) by 137 days.

(21) Appl. No.: 11/377,296

(22) Filed: Mar. 17, 2006

(65) Prior Publication Data

US 2007/0044673 A1 Mar. 1, 2007

Related U.S. Application Data

(60) Provisional application No. 60/662,806, filed on Mar. 18, 2005.

(51) Int. Cl.
*F42C 13/04* (2006.01)
*F42B 1/04* (2006.01)
*F23Q 7/02* (2006.01)

(52) U.S. Cl. ..... 102/206; 102/301

(58) Field of Classification Search ..... 102/206, 102/301, 305, 308, 310, 311
See application file for complete search history.

(56) References Cited

U.S. PATENT DOCUMENTS

| | | | | |
|---|---|---|---|---|
| 4,065,709 | A | 12/1977 | Sliwa et al. | 320/166 |
| 4,762,067 | A | 8/1988 | Barker et al. | 102/313 |
| 4,769,734 | A | 9/1988 | Heinemeyer et al. | 361/56 |
| 4,819,560 | A | 4/1989 | Patz et al. | 102/202.5 |
| 5,038,682 | A | 8/1991 | Marsden | 102/220 |
| 5,933,263 | A | 8/1999 | Kinstler | 398/106 |
| 6,253,679 | B1 * | 7/2001 | Woodall et al. | 102/221 |
| 6,386,108 | B1 | 5/2002 | Brooks et al. | 102/217 |
| 6,584,907 | B2 * | 7/2003 | Boucher et al. | 102/217 |
| 6,618,237 | B2 | 9/2003 | Eddy et al. | 361/249 |
| 6,752,083 | B1 | 6/2004 | Lerche et al. | 102/202.7 |

(Continued)

FOREIGN PATENT DOCUMENTS

BG 102063 U 6/1999

(Continued)

OTHER PUBLICATIONS

MicaPliers—High Voltage Multipliers http://www.teledynereynolds.com/product/12micapliers/pdf/micaplierweb.pdf (Created: Sep. 10, 2001; Viewed online: Feb. 2005).

(Continued)

*Primary Examiner*—Bret Hayes

(57) ABSTRACT

Wireless detonators, and corresponding wireless detonator systems present opportunities for blasting arrangements that avoid the need for physical wire connections between the blasting components. The present application discloses a wireless detonator assembly, a corresponding blasting apparatus, and a method of use thereof. The wireless detonator assembly comprises a charge storage device that is capable of storing charge for discharge into a firing circuit upon receipt of an appropriate wireless command signal to FIRE, from an associated blasting machine. In preferred embodiments, the charge storage device remains or becomes charged, at least for a specific time period, if the wireless detonator assembly receives a suitable "keep alive" command signal from an associated blasting machine—otherwise the charge storage device discharges with little or no effect upon the firing circuit, such that the wireless detonator assembly retain or adopts a safe mode.

32 Claims, 5 Drawing Sheets

U.S. PATENT DOCUMENTS

| | | | | |
|---|---|---|---|---|
| 6,860,206 | B1 * | 3/2005 | Rudakevych et al. | 102/206 |
| 6,889,610 | B2 * | 5/2005 | Boucher et al. | 102/217 |
| 6,988,449 | B2 * | 1/2006 | Teowee et al. | 102/215 |
| 7,143,696 | B2 * | 12/2006 | Rudakevych et al. | 102/215 |
| 2003/0029344 | A1 | 2/2003 | Eddy et al. | 102/200 |
| 2004/0099171 | A1 | 5/2004 | Davies | 102/218 |
| 2005/0011389 | A1 | 1/2005 | Teowee et al. | 102/200 |
| 2005/0015473 | A1 | 1/2005 | Teowee et al. | 709/223 |
| 2006/0207461 | A1 | 9/2006 | Koekemoer et al. | 102/206 |

FOREIGN PATENT DOCUMENTS

| | | |
|---|---|---|
| FR | 2688583 | 9/1993 |
| WO | WO 92/18828 | 10/1992 |
| WO | WO 95/24608 | 9/1995 |
| WO | WO 03/029748 | 4/2003 |

OTHER PUBLICATIONS

Reusable Shock Tube Ignitor STI-8 http://www.risi-usa.com//productpdf/page33.pdf (Created: Sep. 24, 2000; Viewed online: Feb. 2005).

Voltage Multipliers http://www.tpub.com/neets/book7/27m.htm (Viewed online: Feb. 2005).

Low Power Wireless Sensor Applications http://www.cse.cuhk.edu.hk/~phwl/mt/public/archives/students/clyuen.pdf (Created: Jun. 17, 2004; Viewed online: Feb. 2005).

* cited by examiner

WIRELESS DETONATOR ASSEMBLY, AND METHODS OF BLASTING

CROSS-REFERENCE TO RELATED APPLICATIONS

This application claims the priority right of our prior provisional patent application Ser. No. 60/662,806 filed Mar. 18, 2005.

FIELD OF THE INVENTION

The invention relates to the field of wireless detonator assemblies, and methods of blasting employing such assemblies. In particular, the invention relates to detonator assemblies that are substantially free of physical connections with an associated blasting machine, and to improvements in the safety of such wireless detonator assemblies.

BACKGROUND TO THE INVENTION

In mining operations, the efficient fragmentation and breaking of rock by means of explosive charges demands considerable skill and expertise. In most mining operations explosive charges are planted in appropriate quantities at predetermined positions within the rock. The explosive charges are then actuated via detonators having predetermined time delays, thereby providing a desired pattern of blasting and rock fragmentation. Traditionally, signals are transmitted to the detonators from an associated blasting machine via non-electric systems employing low energy detonating cord (LEDC) or shock tube. Alternatively, electrical wires may be used to transmit more sophisticated signals to and from electronic detonators. For example, such signaling may include ARM, DISARM, and delay time instructions for remote programming of the detonator firing sequence. Moreover, as a security feature, detonators may store firing codes and respond to ARM and FIRE signals only upon receipt of matching firing codes from the blasting machine. Electronic detonators can be programmed with time delays with an accuracy of 1 ms or less.

The establishment of a wired blasting arrangement involves the correct positioning of explosive charges within boreholes in the rock, and the proper connection of wires between an associated blasting machine and the detonators. The process is often labour intensive and highly dependent upon the accuracy and conscientiousness of the blast operator. Importantly, the blast operator must ensure that the detonators are in proper signal transmission relationship with a blasting machine, in such a manner that the blasting machine at least can transmit command signals to control each detonator, and in turn actuate each explosive charge. Inadequate connections between components of the blasting arrangement can lead to loss of communication between blasting machines and detonators, and therefore increased safety concerns. Significant care is required to ensure that the wires run between the detonators and an associated blasting machine without disruption, snagging, damage or other interference that could prevent proper control and operation of the detonator via the attached blasting machine.

Wireless detonator systems offer the potential for circumventing these problems, thereby improving safety at the blast site. By avoiding the use of physical connections (e.g. electrical wires, shock tubes, LEDC, or optical cables) between detonators, and other components at the blast site (e.g. blasting machines) the possibility of improper set-up of the blasting arrangement is reduced. Another advantage of wireless detonators relates to facilitation of automated establishment of the explosive charges and associated detonators at the blast site. This may include, for example, automated detonator loading in boreholes, and automated association of a corresponding detonator with each explosive charge, for example involving robotic systems. This would provide dramatic improvements in blast site safety since blast operators would be able to set up the blasting array from entirely remote locations. However, such systems present formidable technological challenges, many of which remain unresolved. One obstacle to automation is the difficulty of robotic manipulation and handling of detonators at the blast site, particularly where the detonators require tieing-in or other forms of hook up to electrical wires, shock tubes or the like. Wireless detonators and corresponding wireless detonator systems may help to circumvent such difficulties, and are clearly more amenable to application with automated mining operations.

However, the development of wireless blasting systems presents new challenges with regard to safety issues. In one example, each wireless detonator assembly must include some form of communication means to allow the receipt, and processing by the wireless detonator assembly of command signals (e.g. ARM, DISARM, FIRE signals etc.) received wirelessly from an associated blasting machine, and optionally the transmission of signals (e.g. including status information, firing codes, delay times etc.) back to an associated blasting machine. For this purpose, each wireless detonator assembly must include some form of independent power supply (an "operating power supply") sufficient to power the signal receiving, processing, and transmission components of the assembly. However, the presence of the operating power supply itself presents an inherent risk of inadvertent detonator actuation resulting from accidental or inappropriate application of the operating electrical power to the firing circuitry. This problem is recognized in the art, and several systems have previously been developed to reduce the risk of inadvertent detonator actuation.

For example, U.S. Pat. No. 5,038,682 issued Aug. 13, 1991 discloses a remote controllable electronic detonator and a method of detonating an explosive charge. The detonator comprises an antenna, a RF receiver, an energy storage capacitor, a switch, a delay time circuit and a fuse. The method comprises the steps of transmitting to the detonator, by means of a transmitter, a wave comprising a carrier amplitude modulated by a low frequency modulating signal, receiving the wave and utilizing energy in the wave to charge a capacitor, enabling the switch by increasing the frequency of the modulating signal and communicating, by means of the wave, a fire command signal to the detonator. After a predetermined time delay, the switch connects the capacitor to the fuse thereby to energize the fuse.

In another example, International Patent Publication WO2003/029748, published Apr. 10, 2003, discloses a blasting system comprising a wireless link between a blast controller and a plurality of electronic detonators. Each detonator comprises a respective electronic initiator and an explosive charge. Charge storage devices of the initiators are chargeable by a carrier of a first signal having a first frequency in the order of 400 MHz-500 MHz and which is broadcasted by the blast controller. Each initiator further comprises logic circuitry driven by a clock signal which is derived from the first signal and having a clock frequency of about 4 kHz, which is substantially less than the first frequency.

Progress has been made in the development wireless detonator assemblies with internal safety features. Nonetheless, existing wireless blasting systems still present significant safety concerns, and improvements are required if wireless blasting systems are to become a more viable alternative to traditional "wired" blasting systems.

SUMMARY OF THE INVENTION

It is an object of the present invention, at least in preferred embodiments, to provide an assembly comprising a detonator or detonator assembly that is capable of wireless communication with an associated blasting machine.

It is another object of the present invention, at least in preferred embodiments, to provide a detonator or detonator assembly in which the risk of inadvertent activation of the firing circuit, and actuation of the base charge is essentially eliminated.

It is yet another object of the present invention, at least in preferred embodiments, to provide a method for wireless communication with a detonator, including an option to fire the detonator, where the risk of inadvertent detonator actuation is substantially eliminated.

The inventors have succeeded in the development of a wireless detonator assembly for use in mining operations, the wireless detonator assembly being capable of communication with a corresponding blasting machine and including features that substantially avoid the risk of accidental detonator actuation resulting from inappropriate use of operating power for communications. In this way, a blast operator working at a blast site can position explosive charges, associate wireless detonator assemblies of the invention with the explosive charges and move away from the blasting site, without the need to establish and lay a multitude of wired connections between the components of the blasting system. Not only does this reduce the time and cost of the blasting operation, but the safety of the overall system is improved.

In one preferred embodiment, the invention includes a wireless detonator assembly comprising a small power source of sufficient strength to power wireless communications circuitry, but insufficient strength to cause actuation of the base charge of the detonator via the firing circuitry. The assembly may further comprise a charge storage device or other form of voltage multiplier that may be charged by the operating power supply, the charge stored therein being discharged to the firing circuitry only in response to a fire signal.

In a first aspect of the present invention there is provided a wireless detonator assembly for use in connection with a blasting machine that transmits at least one wireless command signal to the wireless detonator assembly, the wireless detonator assembly comprising:

a detonator comprising a base charge;

command signal receiving and processing means for receiving and processing the at least one wireless command signal from the blasting machine;

a charge storage device for storing electrical energy;

at least one power source to power the command signal receiving and processing means, and to charge the charge storage device, each of the at least one power source capable of supplying a maximum voltage or current that is less than a threshold voltage or current to actuate the base charge; and a firing circuit in electrical connection with the charge storage device; whereupon receipt by the command signal receiving and processing means of a command signal to FIRE causes the electrical energy stored in the charge storage device to discharge into the firing circuit, the base charge actuating if a voltage or current in the firing circuit resulting from discharge of the electrical energy from the charge storage device exceeds the threshold voltage or current.

Preferably, the base charge actuates in response to a signal to FIRE only if the electric current in the firing circuit is at least 20% greater than a threshold current for firing.

Preferably, the wireless detonator assembly further comprises a firing switch between the charge storage device and the base charge, as part of or in series with the firing circuit, the firing switch biased to an open position and switching to a closed position upon receipt by the command signal receiving and processing means of a signal to FIRE, thereby to cause the electrical energy to discharge from the charge storage device into the firing circuit, to actuate the base charge.

Preferably, the wireless detonator assembly further comprises a charging switch between a power source and the charge storage device, the charging switch having an open position and a closed position, electrical contact being established between the power source and the charge storage device when the charging switch adopts the closed position, thereby to cause charging of the charge storage device.

Preferably, the wireless detonator assembly further comprises comprising a discharging means to bleed charge from the charge storage device via any path except for the firing circuit. More preferably, the discharging means comprises an earth.

In another aspect of the invention, the wireless detonator assembly further comprises:

a charging switch between the power source and the charge storage device, the charging switch having an open position and a closed position, electrical contact being established between the power source and the charge storage device when the charging switch adopts the closed position, thereby to cause charging of the charge storage device; and a discharging means to bleed charge from the charge storage device via any path except the firing circuit;

wherein the charging switch is biased towards an open position such that the charge storage device discharges via the discharging means, and receipt of at least one "keep alive" command signal by the command signal receiving and processing means causes the charging switch to adopt a closed position, thereby to cause charging of the charge storage device.

Preferably, the "keep alive" command signal comprises a continuous signal transmitted by the blasting machine, the charging switch adopting an open position upon removal of, or in the absence of the continuous signal. Alternatively, the "keep alive" command signal causes the charging switch to maintain a closed position for a time period following receipt of the "keep alive" signal by the command signal receiving and processing means, the charging switch adopting an open position at the end of the time period unless the command signal receiving and processing means has received another "keep alive" signal from the blasting machine during the time period. Preferably, the blasting machine transmits a series of "keep alive" signals to maintain the charging switch in the closed position so that the charge storage device remains at least substantially charged, the base charge being actuatable by discharge of the electrical energy into the firing circuit upon receipt of a command signal to FIRE.

Preferably, the discharging means is in electrical connection with the charging switch, such that when the charging switch is in an open position the charge storage device is connected to the discharging means but is not connected to the power supply thereby to cause bleeding of the charge in the charge storage device, and when the charging switch is in a closed position the charge storage device is connected to the power supply but is not connected to the discharging means thereby to cause charging of the charge storage device.

Preferably, the charge storage device is selected from the group consisting of: a capacitor, diode, rechargeable battery or activatable battery.

Preferably, the command signals are selected from the group consisting of: ARM signals, DISARM signals, FIRE signals, detonator delay times, and detonator firing codes.

Preferably, the wireless detonator assembly further comprises signal transmission means for generating and transmitting at least one communication signal for receipt by the blasting machine. More preferably, each communication signal comprises detonator delay times, detonator firing codes, or detonator status information.

Preferably, the wireless command signals comprise radio waves, electromagnetic energy, or acoustic energy. More preferably, the wireless command signals comprise ULF radio waves. Preferably, the wireless command signals comprise radio waves having a frequency of from 100 to 2000 Hz. More preferably, the wireless command signals comprise radio waves having a frequency of from 200 to 1200 Hz.

Preferably, in use the base charge is located in a detonator shell down a borehole in association with an explosive charge, and at least the signal receiving and processing means, the charge storage device, and the power supply are located at or near a surface of the ground. More preferably, at least the signal receiving and processing means, the charge storage device, and the power supply are located in a top-box at or near a surface of the ground.

Preferably, the at least one power source comprises an active power source to provide power at least to the signal receiving and processing means, and an energy receiving means for receiving energy from a remote energy source, the energy receiving means transferring the energy to a converting means for converting the energy to electrical energy, the converting means providing the electrical energy to charge the charge storage device.

Preferably, the remote energy source is a laser, the energy receiving means is a light capture device, and the converting means is a photodiode.

In another aspect the present invention provides for a blasting apparatus comprising:

at least one blasting machine capable of transmitting command signals to associated wireless detonator assemblies via wireless communications;

at least one explosive charge;

at least one wireless detonator assembly of the present invention associated with each explosive charge and in wireless signal communication with the at least one blasting machine. Preferably, the blasting apparatus further comprises a central command station, the central command station transmitting command signals to the at least one blasting machine, the at least one blasting machine responding to the command signals or relaying the command signals to the at least one wireless detonator assembly.

In another aspect the present invention provides for a method of blasting at a blast site, the method comprising the steps of:

providing a blasting system of the invention;

placing a plurality of explosive charges at the blast site;

associating a wireless detonator assembly with each explosive charge such that actuation of each base charge will cause actuation of each associated explosive charge;

transmitting at least one "keep alive" command signal from the at least one blasting machine to each wireless detonator assembly, to cause each charging switch of each wireless detonator assembly to adopt a closed position, thereby to charge each charge storage device;

transmitting a FIRE signal from the at least one blasting machine to each wireless detonator assembly, to cause discharge of electrical energy from each charge storage device into each firing circuit, thereby causing actuation of each base charge.

Preferably, in accordance with the methods of the invention, the command signals further comprise delay times for each detonator, thereby to cause the detonators to fire in a specific timing pattern.

Preferably, in accordance with the methods of the invention, each detonator comprises a stored firing code, and the command signals further comprise firing codes, each detonator firing only if a stored firing code and a firing code from a command signal correspond.

In another aspect of the invention there is provided a use of the wireless detonator assembly or blasting apparatus of the present invention, in a mining operation. Preferably, the mining operation is an automated mining operation comprising robotic placement of explosive charges and wireless detonator assemblies at the blast site.

In another aspect there is provided a wireless detonator assembly for use in connection with a blasting machine that transmits at least one wireless command signal to the wireless detonator assembly, the wireless detonator assembly comprising:

a detonator comprising a base charge;

command signal receiving and processing means for receiving and processing said at least one wireless command signal from said blasting machine;

a charge storage device for storing electrical energy at least one power source to power said command signal receiving and processing means, and to charge said charge storage device, each of said at least one power source capable of supplying a maximum voltage or current that is less than a threshold voltage or current to actuate said base charge;

a firing circuit in electrical connection with said base charge;

a charging switch between a charging power source and the charge storage device, said charging switch having an open position and a closed position, electrical contact being established between said power source and said charge storage device when said charging switch adopts said closed position, thereby to cause charging of said charge storage device; and a discharging means to bleed charge from said charge storage device via any path except for said firing circuit, the discharging means being in electrical connection with the charging switch, such that when the charging switch is in an open position the charge storage device is connected to the discharging means but is not connected to the power supply thereby to cause bleeding of the charge in the charge storage device, and upon receipt by said command signal receiving and processing means of at least one "keep alive" command signal, said charging switch adopting a closed position such that the charge storage device is connected to the power supply but is not connected to the discharging means thereby to cause charging of the charge storage device;

whereupon receipt by said command signal receiving and processing means of a command signal to FIRE said electrical energy stored in said charge storage device is discharged into said firing circuit, said base charge actuating if a voltage or current in said firing circuit resulting from discharge of said electrical energy from said charge storage device exceeds said threshold voltage or current.

DEFINITIONS

Figure 1:
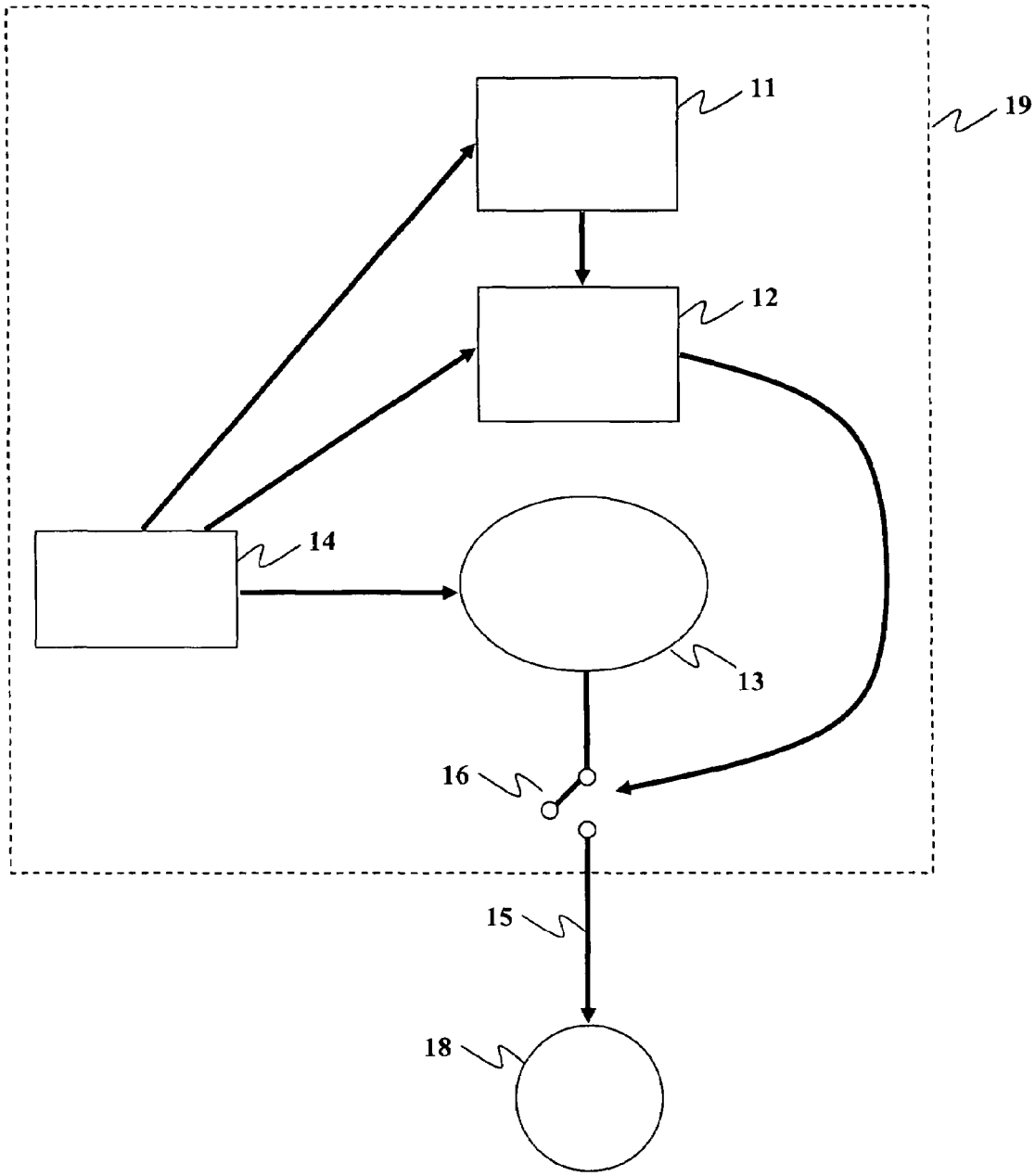
FIG. 1 schematically illustrates one preferred embodiment of a wireless detonator assembly of the invention.

Active power source: refers to any power source that can provide a continuous or constant supply of electrical energy. This definition encompasses devices that direct current such as a battery or a device that provides a direct or alternating current. Typically, an active power source provides power to a command signal receiving and/or processing means, to permit reliable reception and interpretation of command signals derived from a blasting machine.

Automated/automatic blasting event: encompasses all methods and blasting systems that are amenable to establishment via remote means for example employing robotic systems at the blast site. In this way, blast operators may set up a blasting system, including an array of detonators and explosive charges, at the blast site from a remote location, and control the robotic systems to set-up the blasting system without need to be in the vicinity of the blast site.

Base charge: refers to any discrete portion of explosive material in the proximity of other components of the detonator and associated with those components in a manner that allows the explosive material to actuate upon receipt of appropriate signals from the other components. The base charge may be retained within the main casing of a detonator, or alternatively may be located nearby the main casing of a detonator. The base charge may be used to deliver output power to an external explosives charge to initiate the external explosives charge.

Blasting machine: refers to any device that is capable of being in signal communication with electronic detonators, for example to send ARM, DISARM, and FIRE signals to the detonators, and/or to program the detonators with delay times and/or firing codes. The blasting machine may also be capable of receiving information such as delay times or firing codes from the detonators directly, or this may be achieved via an intermediate device such as a logger to collect detonator information and transfer the information to the blasting machine.

Central command station: refers to any device that transmits signals via radio-transmission or by direct connection, to one or more blasting machines. The transmitted signals may be encoded, or encrypted. Typically, the central blasting station permits radio communication with multiple blasting machines from a location remote from the blast site.

Charge/charging: refers to a process of supplying electrical power from a power supply to a charge storage device, with the aim of increasing an amount of electrical charge stored by the charge storage device. As desired in preferred embodiments, the charge in the charge storage device may surpass a threshold sufficiently high such that discharging of the charge storage device via a firing circuit causes actuation of a base charge associated with the firing circuit.

Charge storage device: refers to any device capable of storing electrical charge. Such a device may include, for example, a capacitor, diode, rechargeable battery or activatable battery. At least in preferred embodiments, the potential difference of electrical energy used to charge the charge storage device is less or significantly less than the potential difference of the electrical energy upon discharge of the charge storage device into a firing circuit. In this way, the charge storage device may act as a voltage multiplier, wherein the device enables the generation of a voltage that exceeds a predetermined threshold voltage to cause actuation of a base charge connected to the firing circuit.

Clock: encompasses any clock suitable for use in connection with a wireless detonator assembly and blasting system of the invention, for example to time delay times for detonator actuation during a blasting event. In particularly preferred embodiments, the term clock relates to a crystal clock, for example comprising an oscillating quartz crystal of the type that is well know, for example in conventional quartz watches and timing devices. Crystal clocks may provide particularly accurate timing in accordance with preferred aspects of the invention, and their fragile nature may in part be overcome by the teachings of the present application.

Electromagnetic energy: encompasses energy of all wavelengths found in the electromagnetic spectra. This includes wavelengths of the electromagnetic spectrum division of γ-rays, X-rays, ultraviolet, visible, infrared, microwave, and radio waves including UHF, VHF, Short wave, Medium Wave, Long Wave, VLF and ULF. Preferred embodiments use wavelengths found in radio, visible or microwave division of the electromagnetic spectrum.

Forms of energy: In accordance with the present invention, "forms" of energy may take any form appropriate for wireless communication and/or wireless charging of the detonators. For example, such forms of energy may include, but are not limited to, electromagnetic energy including light, infrared, radio waves (including ULF), and microwaves, or alternatively make take some other form such as electromagnetic induction or acoustic energy. In addition, "forms" of energy may pertain to the same type of energy (e.g. light, infrared, radio waves, microwaves etc.) but involve different wavelengths or frequencies of the energy.

"Keep alive" signal: refers to any signal originating from a blasting machine and transmitted to a wireless detonator assembly, either directly or indirectly (e.g. via other components or relayed via other wireless detonator assemblies), that causes a charge storage device of the wireless detonator assembly to be charged by a power source and/or to retain charge already stored therein. In this way, the charge storage device retains sufficient charge so that upon receipt of a signal to FIRE, the charge is discharged into the firing circuit to cause a base charge associated with the firing circuit to be actuated. The "keep alive" signal may comprise any form of suitable energy identified herein. Moreover, the "keep alive" signal may be a constant signal, such that the wireless detonator assembly is primed to FIRE at any time over the duration of the signal in response to an appropriate FIRE signal. Alternatively, the "keep alive" signal may comprise a single signal to prime the wireless detonator assembly to FIRE at any time during a predetermined time period in response to a signal to FIRE. In this way, the wireless detonator assembly may retain a suitable status for firing upon receipt of a series of temporally spaced "keep alive" signals.

Logging device: includes any device suitable for recording information with regard to a detonator at the blast site. Preferably, the logging device may also record additional information such as, for example, identification codes for each detonator, information regarding the environment of the detonator, the nature of the explosive charge in connection with the detonator etc. In selected embodiments, a logging device may form an integral part of a blasting machine, or alternatively may pertain to a distinct device such as for example, a portable programmable unit comprising memory means for storing data relating to each detonator, and preferably means to transfer this data to a central command station or one or more blasting machines. One principal function of the logging device, is to read the detonator/assembly ID so that the detonator can be "found" by an associated blasting machine, and have commands such as FIRE commands directed to it as appropriate.

Micro-nuclear power source: refers to any power source suitable for powering the operating circuitry, communications circuitry, or firing circuitry of a detonator or wireless detonator assembly according to the present invention. The nature of the nuclear material in the device is variable and may include, for example, a tritium based battery.

Passive power source: includes any electrical source of power that does not provide power on a continuous basis, but rather provides power when induced to do so via external stimulus. Such power sources include, but are not limited to, a diode, a capacitor, a rechargeable battery, or an activatable battery. Preferably, a passive power source is a power source that may be charged and discharged with ease according to received energy and other signals. Most preferably the passive power source is a capacitor.

Power supply (without recitation of the power source being an 'active power source' or a 'passive power source'): refers to a power supply that is capable of supplying a fairly constant supply of electrical power, or at least can provide electrical power as and when required by connected components. For example, such power supplies may include but are not limited to a battery.

Preferably: identifies preferred features of the invention. Unless otherwise specified, the term preferably refers to preferred features of the broadest embodiments of the invention, as defined for example by the independent claims, and other inventions disclosed herein.

Top-box: refers to any device forming part of a wireless detonator assembly that is adapted for location at or near the surface of the ground when the wireless detonator assembly is in use at a blast site in association with a bore-hole and explosive charge located therein. Top-boxes are typically located above-ground or at least in a position in, at or near the borehole that is more suited to receipt and transmission of wireless signals, and for relaying these signals to the detonator down the borehole. In preferred embodiments, each top-box comprises one or more selected components of the wireless detonator assembly of the present invention.

Wireless: refers to there being no physical wires (such as electrical wires, shock tubes, LEDC, or optical cables) connecting the detonator of the invention or components thereof to an associated blasting machine or power source.

Wireless detonator assembly: In general the expression "wireless detonator assembly" encompasses a detonator, most preferably an electronic detonator (typically comprising at least a detonator shell and a base charge) as well as means to cause actuation of the base charge upon receipt by said wireless detonator assembly of a signal to FIRE from at least one associated blasting machine. For example, such means to cause actuation may include signal receiving means, signal processing means, and a firing circuit to be activated in the event of a receipt of a FIRE signal. Preferred components of the wireless detonator assembly may further include means to transmit information regarding the assembly to other assemblies or to a blasting machine, or means to relay wireless signals to other components of the blasting apparatus. Other preferred components of a wireless detonator assembly will become apparent from the specification as a whole. The expression "wireless detonator assembly" may in very specific embodiments pertain simply to a wireless signal relay device, without any association to a detonator unit. In such embodiments, such relay devices may form wireless trunk lines for simply relaying wireless signals to and from blasting machines, whereas other wireless detonator assemblies in communication with the relay devices may comprise all the usual features of a wireless detonator assembly, including a detonator for actuation thereof, in effect forming wireless branch lines in the wireless network. A wireless detonator assembly may further include a top-box as defined herein, for retaining specific components of the assembly away from an underground portion of the assembly during operation, and for location in a position better suited for receipt of wireless signals derived for example from a blasting machine or relayed by another wireless detonator assembly.

DETAILED DESCRIPTION OF THE PREFERRED EMBODIMENTS

Wireless blasting systems help circumvent the need for complex wiring systems at the blast site, and associated risks of improper placement, association and connection of the components of the blasting system. However, the development of wireless communications systems for blasting operations has presented significant new challenges for the industry, including new safety issues.

Through careful investigation, the inventors have determined that the wireless detonators and blasting systems of the prior art are problematic with regard to inadvertent or accidental actuation of the detonators. Rapid and accurate communication between a blasting machine, and associated detonators presents a difficult challenge, regardless of the nature of the wireless communication systems. One of the most important signals that must be properly and accurately processed by a wireless detonator is the signal to FIRE. Failure of the communication systems to fire detonators on command, or improper detonator actuation at any other time, can result in a significant risk of serious injury or death for those blast operators working at the blast site. Therefore, prevention of inadvertent or accidental detonator actuation is of paramount importance to blasting operations.

The present invention provides a wireless detonator assembly, a corresponding blasting apparatus comprising the wireless detonator assembly, and a method involving the wireless detonator assembly. The wireless detonator assembly of the present invention utilizes a combination of components to provide a way to substantially avoid inadvertent detonator actuation. In a particularly preferred feature, the wireless detonator assembly of the invention involves the use of a power source of sufficient power to operate the command signal receiving and processing circuitry of the assembly, but of insufficient power to accidentally activate the firing circuitry, or actuate the base charge. In this way, wireless communication by an associated blasting machine with the wireless detonator assembly, for example to communicate ARM, DISARM, or FIRE signals, as well as delay times and firing codes, will substantially avoid inadvertent detonator firing since the intrinsic nature of the detonator is to be in a "safe mode".

The wireless detonator assembly of the invention generally comprises a detonator comprising a base charge; command signal receiving and processing means for receiving and processing at least one wireless command signal from an associated blasting machine; a charge storage device for storing electrical energy; at least one power source to power said command signal receiving and processing means, and to charge said charge storage device; and a firing circuit in electrical connection with said charge storage device. Upon receipt of a signal to FIRE from an associated blasting machine, electrical energy stored in the charge storage device discharges into the firing circuit to generate an electric current in the firing circuit, thereby to actuate the base charge.

One embodiment of the invention is illustrated in FIG. 1. The detonator assembly shown generally at 10 comprises a command signal receiving means 11 and a command signal processing means 12. The receiving and processing means may take the form of individual unitary devices, or may comprise a single device for signal reception and processing. The nature of the receiving means will depend upon the nature of the incoming wireless command signal from the blasting machine. For example if the wireless command signals are transmitted as radio waves from the blasting machine then the receiving means may include some form of RF antennae. Alternatively if the wireless command signal from the blasting machine includes some form of electromagnetic energy such as laser light, then the receiving means may comprise some form of light capture device. In any event, the wireless detonator assembly is responsive to signals received and processed by the receiving means 11, and the processing means 12.

The wireless detonator assembly 10 further comprises a charge storage device 13 suitable for storing electrical charge and releasing the stored electrical charge as required. The charge storage device 13 may take the form of any suitable device capable of being charged by the application thereto of an electric current, and capable of being discharged in response to a suitable signal, as will become apparent below. In the embodiment illustrated in FIG. 1, the charge storage device 13 is in electrical connection with a power supply 14, such that the power supply 14 is suitable for charging the charge storage device 13, and retaining the charge storage device in a charged or substantially charged state.

Switch 16 is located between charge storage device 13 and firing circuit 15, which includes base charge 18. In other embodiments, switch 16 may form part of firing circuit 15 to achieve a similar effect. Signal processing means 12 controls the switch 16 to determine whether switch 16 adopts an open state, in which no electrical connection exists between the charge storage device 13 and the base charge 18. However, upon receipt by the receiving means of a wireless command signal to FIRE, the signal processing means 12 provides an electrical signal to cause switch 16 to close, thereby establishing electrical connection between charge storage device 13 and base charge 18. As a result, the charge in charge storage device 13 is discharged into the firing circuit 15, and if the resulting electric current or voltage in the firing circuit is sufficiently high, the base charge is induced to actuate.

FIG. 1 also illustrates a particularly preferred embodiment of the invention, which involves the use of a top-box 19. Typically, a top box is a unit for containing selected components of the wireless detonator assembly and retaining those components at or near a surface of the ground when the wireless detonator assembly is in use at a blast site in association with a bore-hole and explosive charge located therein. Top-boxes are typically located above-ground or at least in a position in, at or near the borehole that is more suited to receipt and transmission of wireless signals, and for relaying these signals to the detonator down the borehole. In preferred embodiments, each top-box comprises one or more selected components of the wireless detonator assembly of the present invention. Moreover, use of a top-box allows for sensitive components (e.g. clock components) to be retained away from the bore-hole, and explosive charge contained therein.

In FIG. 1, the power supply 14 is shown to supply power to three components, namely the signal receiving means 11, the signal processing means 12, and the charge storage device 13. In this way, the power supply may comprise a voltage sufficient to power the communications devices 11 and 12 of the wireless detonator assembly, and sufficient to supply charge to the charge storage device. However, the power supply 14 has a voltage insufficient to cause actuation of the base charge, under circumstances where the power supply is somehow accidentally or inadvertently in direct contact with the firing circuit. In this way, the base charge can actuate only in response to a voltage that is higher than a predetermined threshold voltage, and the threshold voltage is higher than any voltage that can be supplied by the power supply. In effect, the charge storage device 13 functions as a voltage multiplier. By accepting electrical energy supplied by the power supply, temporarily storing this energy, and discharging the energy into the firing circuit in response to a FIRE signal, the charge storage device can supply a voltage or current to the firing circuit that exceeds the threshold voltage or current for actuation of the base charge.

In the embodiment illustrated in FIG. 1, and indeed in any of the embodiments described herein, the power supply 14 may supply power only to the communications components 11, 12 of the wireless detonator assembly. A separate power supply (not shown) may be used to provide power to the charge storage device. This separate power supply may form an integral component of the wireless detonator assembly, and for example may take the form of a battery.

Alternatively, the separate power supply may comprise an external source of power that supplies energy for charging the charge storage device from a location remote from the wireless detonator assembly. For example, applicant's co-pending U.S. patent application Ser. No. 60/623,941, filed Nov. 2, 2004 which is incorporated herein by reference, discloses a wireless detonator assembly, a corresponding blasting system, and a method of use thereof, that involves the use of intrinsically safe detonators that may be 'powered-up' or 'charged' by a remote source of energy that is entirely distinct from the energy used by the wireless detonator assembly for general command signal communications. The wireless detonator assemblies may further include an active power source for supplying sufficient power for wireless communications, but insufficient power to cause accidental actuation of the base charge of the detonator. In this way, the wireless detonator assemblies are powered by two entirely distinct forms of energy, one form (e.g. radio waves) for general communications, and another form (e.g. light energy, which is converted to electrical energy by components of the wireless detonator assembly) for providing electrical energy to the firing circuit.

Figure 2:
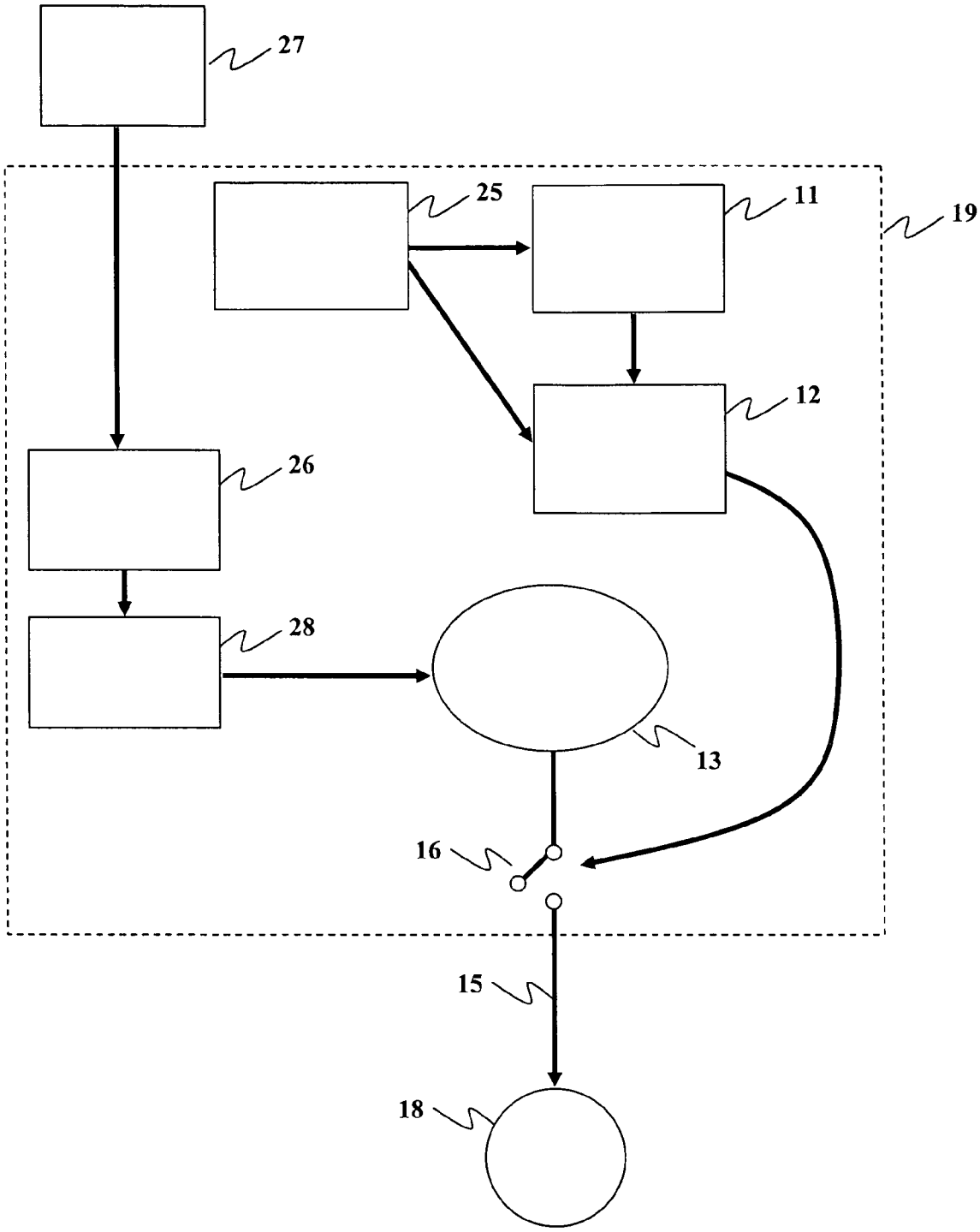
FIG. 2 schematically illustrates one preferred embodiment of a wireless detonator assembly of the invention.

In preferred embodiments the present invention may be used in conjunction with the technology taught in U.S. patent application Ser. No. 60/623,941. For example, as illustrated in FIG. 2, the wireless detonator assembly of the present invention may include an active power source 25 suitable for providing power to the signal receiving means 11 and the signal processing means 12. In addition, the wireless detonator assembly may include an energy receiving means 26 for wirelessly receiving another form of energy (i.e. a form of energy that is different to the energy of the active power source) transmitted by a remote energy source 27; and converting means 28 for converting the other form of energy received by the energy receiving means to electrical energy. In this embodiment, the charge storage device 13 is in electrical connection with the converting means 28 and is capable of being charged by electrical energy derived from the converting means. Typically, the voltage of electrical energy derived from the converting means will be insufficient to cause accidental actuation of the base charge. In other respects, the embodiment illustrated in FIG. 2 is similar to FIG. 1, in that upon receipt of a command signal to FIRE by said command signal receiving means electrical energy stored in the charge storage device is discharged into the firing circuit thereby to actuate the base charge. The use of an external power source to charge up the charge storage device, and effectively 'prime' the wireless detonator assembly for actuation of the base charge, has been illustrated with comparative reference to FIG. 1. However, the technology disclosed in U.S. patent application Ser. No. 60/623,941 may be applied to any of the embodiments of the present invention specifically described herein, and other embodiments that are within the scope of the invention.

Figure 3:
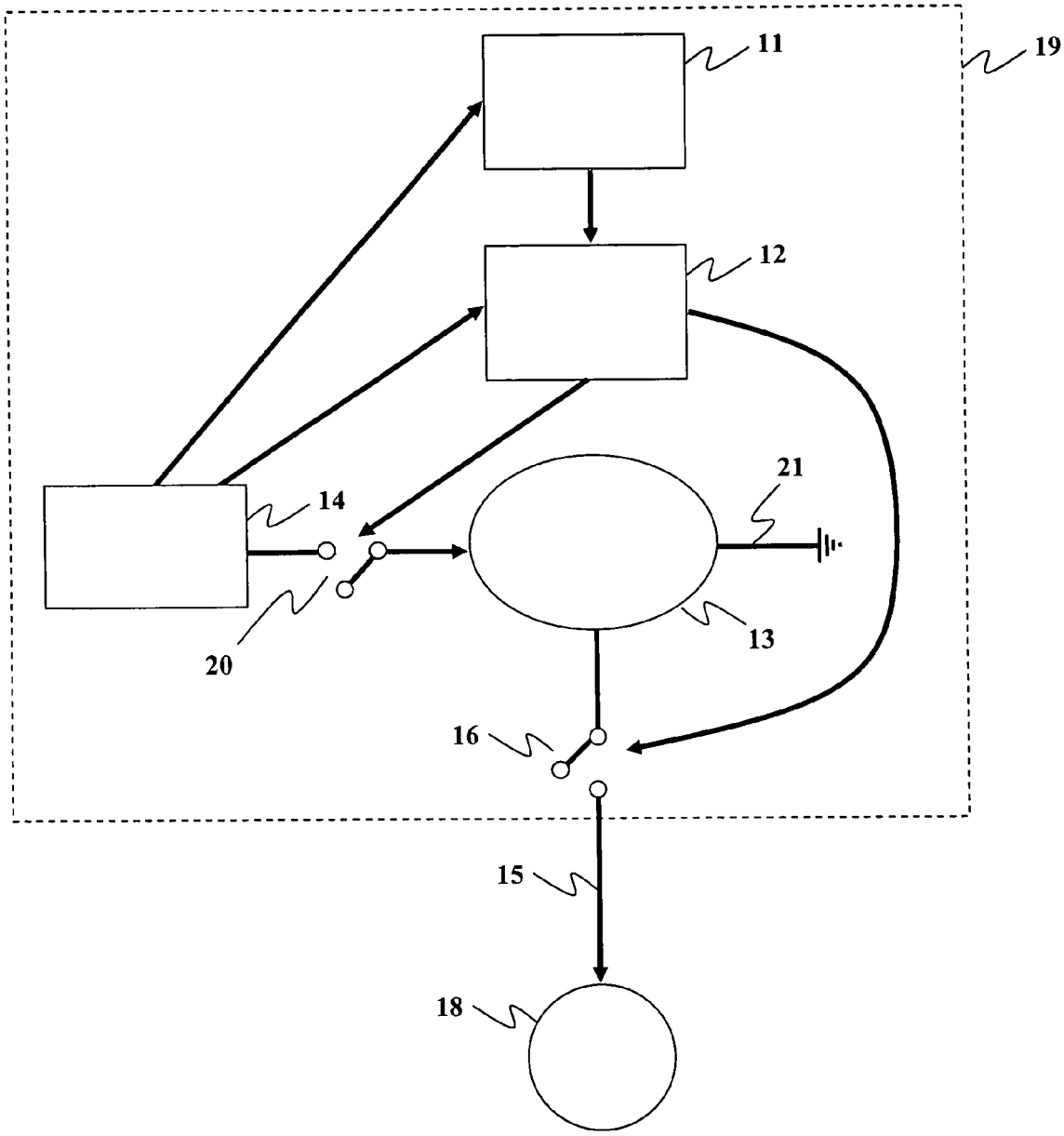
FIG. 3 schematically illustrates one preferred embodiment of a wireless detonator assembly of the invention.

Turning now to FIG. 3, there is illustrated an embodiment of the invention that is similar to the embodiment illustrated by FIG. 1. However, two preferred features have been added. Firstly, a charging switch 20 has been added between the power supply 14 and the charge storage device 13. When the charging switch 20 adopts an open position, no electrical contact exists between the power supply and the charge storage device. Upon transmission by an associated blasting machine of a "keep alive" signal, and receipt of the "keep alive" signal by the signal receiving means 11, the signal processing means 12 causes the charging switch 20 to close, thereby establishing electrical contact between the power supply 14 and the charge storage device 13. This in turn causes the charge storage device to become charged and/or remain charged to a degree suitable for actuation of the base upon receipt by the wireless detonator assembly of a signal to FIRE. The "keep alive" signal may be a constant signal, such that the wireless detonator assembly is primed to FIRE at any time over the duration of the signal in response to an appropriate FIRE signal. Alternatively, the 'keep alive" signal may comprise a single signal to prime the wireless detonator assembly to FIRE at any time during a predetermined time period in response to a signal to FIRE. In this way, the wireless detonator assembly may retain a suitable status for firing upon receipt of a series of temporally spaced "keep alive" signals.

The second preferred feature illustrated in FIG. 3 is the discharging means 21. As illustrated, the discharging means has a simple direct link to the charge storage device 13, and bleeds charge from the charge storage device via a route other than the firing circuit. If charging switch 20 adopts an open position, no electrical energy is transferred from the power supply 14 to the charge storage device 13, resulting in a reduction over time of the amount of charge stored by the charge storage device. If the discharge from the charge storage device is sufficiently great, the charge storage device may hold insufficient charge to cause actuation of the base charge, even upon receipt of a signal to FIRE from an associated blasting machine. In this way, the absence of a "keep alive" signal from the blasting machine causes discharge of the charge storage device, and the wireless detonator assembly thereby adopts a safe mode, in which actuation of the base charge is substantially avoided, even in the presence of other influences that might cause inadvertent or accidental actuation of the base charge (e.g. an errant signal to FIRE, electrostatic interference, improper direction of energy from the power supply).

The discharging means 21 may take any form that achieves a reduction of charge in the charge storage device, providing that the charge is dissipated by some route other than via the firing circuit. In selected embodiments the discharging means may take the form of an earth. The rate of discharge via the discharging means may be varied according to operational circumstances. For example, a slow rate of discharge may be suitable where circumstances require the wireless detonator assembly to maintain a primed or charged state for firing over an extended period following receipt by the wireless detonator assembly of a "keep alive" signal. On the other hand, it may be desirable to have each wireless detonator assembly rapidly default to a safe mode in the absence of, or upon withdrawal of, a "keep alive" signal, for example so that the blast site can be rapidly accessed and the blasting arrangement modified. Under these circumstances, it may be desirable to use a discharging means that achieves rapid discharge of the charge storage device so that the wireless detonator assembly adopts a safe mode with minimal delay.

Although an earth (ground) is illustrated in FIG. 3, any form of discharging means may be used in accordance with the present invention to continuously or selectively bleed charge from the passive power source, for example through bleed resistors or the like. For this reason, a "leaky" capacitor or other charge storage device is also encompassed by the expression "discharging means" merely by virtue of its charge leakiness. Another alternative would include a shorting switch and associated circuitry that is activated if the "keep active" signal is not received, for example within a certain time interval.

Deactivation of the blasting apparatus may also be achieved via alternative routes to bleeding of the passive power source. For example, the blasting apparatus may include switching to electrically isolate any one or more of the passive power source, active power source, fuse head, firing circuit or any other component of the blasting apparatus. This approach may, at least in selected embodiments, be used in combination with a discharging means, leaky capacitor or the equivalent.

Figure 4:
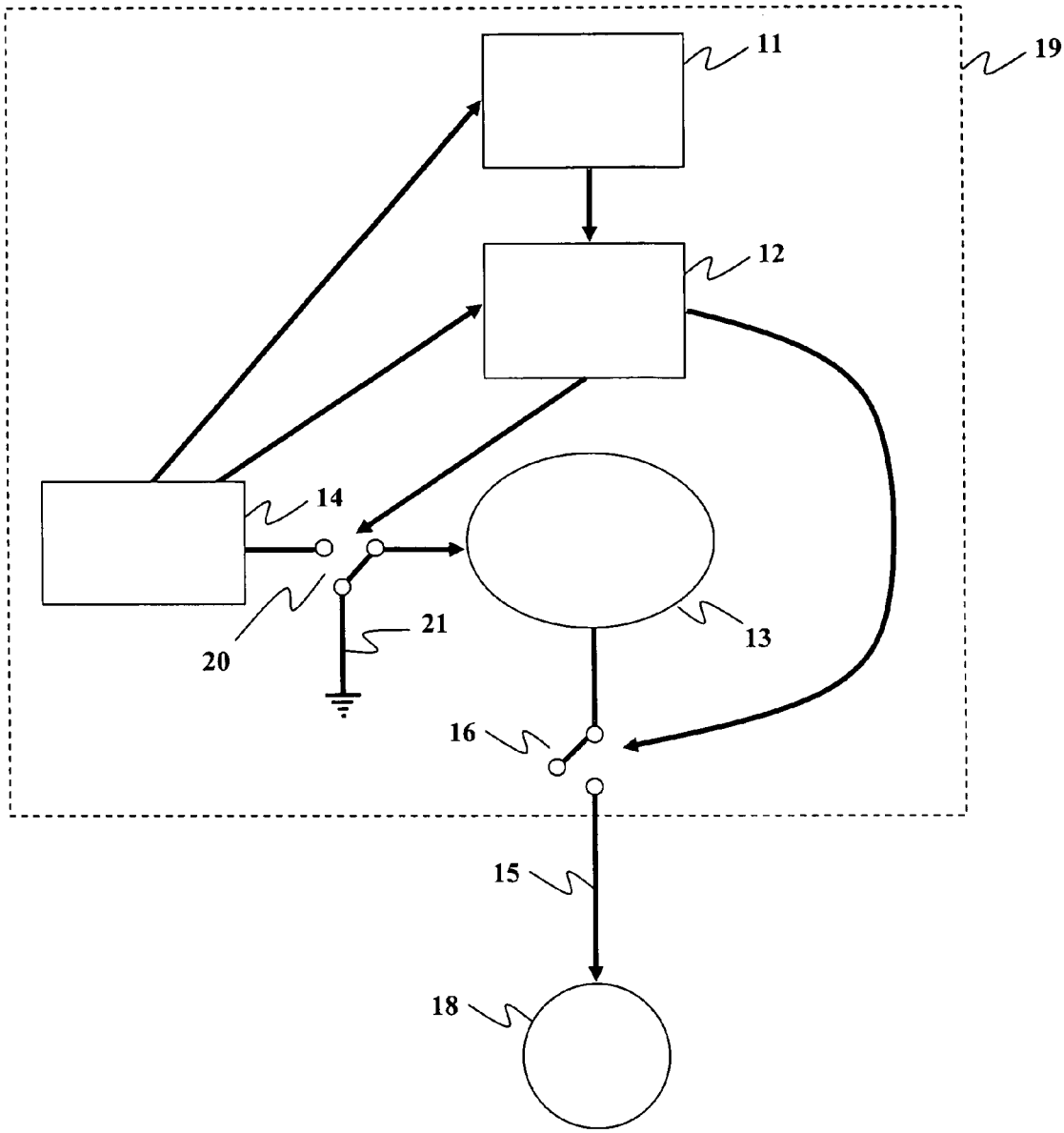
FIG. 4 schematically illustrates one preferred embodiment of a wireless detonator assembly of the invention.

A variant of the embodiment illustrated in FIG. 3, is shown in FIG. 4. This embodiment includes substantially the same components previously described. However, the components are arranged in a different manor to achieve further advantages. Specifically, the discharging means 21, instead of being connected directly to the charge storage device 13 is connected indirectly to the charge storage device via charging switch 20. When the charging switch 20 adopts an open position an electrical connection exists between the charge storage device 13 and the discharging means 21. However, in contrast to the embodiment in FIG. 3, when the charging switch is in an open position the power supply 14 is not connected to the charge storage device. In this way, the discharging means can discharge the charge storage device without working against the power supply. When the wireless detonator assembly responds to a "keep alive" signal from an associated blasting machine, the charging switch closes resulting in a loss of electrical connection between the charge storage device and the discharging means, and establishment of an electrical connection between the charge storage device and the power supply 14. In this way, the charge storage device is charged by the power supply without simultaneous bleeding of charge by the discharging means. As a result the charging and discharging of the charge storage device is more efficient and rapid compared with the embodiment illustrated in FIG. 3. Moreover, in the embodiment illustrated in FIG. 3 it is necessary for the rate of charging by the power supply 14 to exceed the rate of discharging by the discharging means when the charging switch 20 is in the closed position, otherwise the charge storage means 13 would not be charged in response to a "keep alive" signal. This is not required in the embodiment illustrated in FIG. 4, since charging will occur when the charging switch 20 is in the closed position, even if the rate of charging by the power supply (when the charging switch is in the closed position) is generally less than the rate of discharging by the discharging means (when the charging switch is in the open position).

In other embodiments, the invention provides for a blasting apparatus comprising at least one wireless detonator assembly of the invention together with other units and devices necessary to conduct a blasting event at a blast site. For example, such additional units or devices may include, but are not limited to: at least one blasting machine capable of receiving command signals from a central command station, and transferring said command signals to associated wireless detonator assemblies via wireless communications; and at least one explosive charge each suitable for association with a base charge of a wireless detonator assembly. Preferably, the blasting apparatus may further include a central command station for transmitting command signals to each blasting machine, whereupon each blasting machine may act upon the command signals, and/or relay the command signals to the at least one wireless detonator assembly.

The present invention also encompasses the use of the wireless detonator assemblies described herein, as part of a network of wireless detonator assemblies and at least one blasting machine, as described for example in U.S. patent application Ser. No. 60/646,312 filed Jan. 24, 2005, which is incorporated herein by reference. This previous application teaches blasting apparatuses, and methods for their use, that employ a network of blasting machines and wireless detonator assemblies, each wireless detonator assembly capable of wireless communication not only with the blasting machine (s), but also with other wireless detonator assemblies, so that those wireless detonator assemblies (and associated components) that are "blind" to communication with the blasting machines can remain functional in the blasting network. For example, in one specific embodiment, U.S. patent application Ser. No. 60/646,312 discloses a blasting apparatus for fragmentation of rock by timed actuation of a plurality of explosive charges each set in a borehole in the rock, the blasting apparatus comprising: at least one blasting machine for transmitting at least one wireless command signal; and a plurality of wireless detonator assemblies, at lease some of which are within range to receive said at least one wireless signal from said at least one blasting machine, each wireless detonator assembly associated with a corresponding explosive charge for causing actuation thereof upon transmission of a FIRE signal by an associated blasting machine, each wireless detonator assembly comprising:

(a) a base charge;

(b) wireless signal receiving means, for receiving at least one wireless signal, each wireless signal transmitted from either a blasting machine or another nearby wireless detonator assembly;

(c) wireless signal processing means for determining an action required by said wireless detonator assembly in response to each wireless signal received by (b), and whether to relay said wireless signal to another wireless detonator assembly and/or to a blasting machine; and (d) wireless signal transmitting means for transmitting said at least one wireless signal as required by (c);

whereby the wireless detonator assemblies form a cross-communicating network of wireless detonator assemblies, each either in direct communication with said at least one blasting machine, or in indirect communication with said at least one blasting machine via relay of wireless signals to or from said at least one blasting machine via one or more nodes in the network, each node comprising a wireless detonator assembly. It is within the scope of the present application to encompass blasting apparatuses of the type disclosed in U.S. application Ser. No. 60/646,312 that employ the wireless detonator assemblies of the present invention to form the cross-communicating network.

Figure 5:
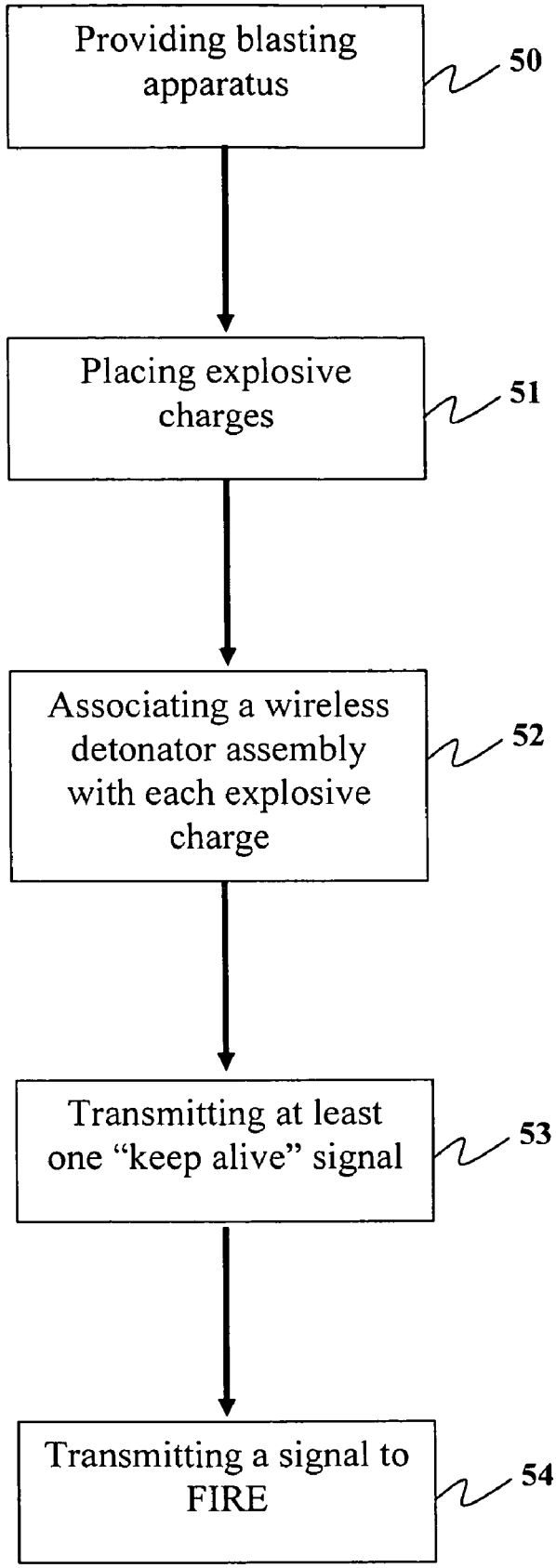
FIG. 5 is a flow chart diagram of one preferred embodiment of a method for blasting using a wireless detonator assembly of and blasting system of the invention.

With reference to FIG. 5, the invention also provides for a method of blasting at a blast site, the method comprising the steps of: providing in step 50 a blasting apparatus of the present invention; in step 51 placing a plurality of explosive charges at the blast site; in step 52 associating a wireless detonator assembly with each explosive charge such that actuation of each base charge will cause actuation of each associated explosive charge; in step 53 transmitting at least one "keep alive" command signal from said at least one blasting machine to each wireless detonator assembly, such that each charging switch of each wireless detonator assembly adopts a closed position, thereby to charge each charge storage device; in step 54 transmitting a FIRE signal from said at least one blasting machine to each wireless detonator assembly, to cause discharge of electrical energy from each charge storage device into each firing circuit, thereby causing actuation of each base charge. In preferred embodiments the command signals may further comprise delay times for each detonator, thereby to cause the detonators to fire in a specific timing pattern. In further preferred embodiments each detonator may comprise a stored firing code, and the command signals may further comprise firing codes, each detonator firing only if a stored firing code and a firing code from a command signal correspond.

The present invention also provides for the use of any wireless detonator assembly of any embodiment of the invention, in a mining operation. In preferred embodiments, the mining operation is an automated mining operation comprising robotic placement of explosive charges and wireless detonator assemblies at the blast site.

Whilst the invention has been described with reference to specific embodiments of the wireless detonator assemblies, blasting systems, and methods of blasting of the present invention, a person of skill in the art would recognize that other wireless detonator assemblies, blasting systems, and methods of blasting that have not been specifically described would nonetheless lie within the spirit of the invention. It is intended to encompass all such embodiments within the scope of the appended claims.

The invention claimed is:

1. A wireless detonator assembly for use in connection with a blasting machine that transmits at least one wireless command signal to the wireless detonator assembly, the wireless detonator assembly comprising:

a detonator comprising a base charge;

command signal receiving and processing means for receiving and processing said at least one wireless command signal from said blasting machine;

a charge storage device for storing electrical energy;

at least one power source to power said command signal receiving and processing means, and to charge said charge storage device, each of said at least one power source supplying a maximum voltage or current that is less than a threshold voltage or current to actuate said base charge; and a firing circuit in electrical connection with said charge storage device;

whereupon receipt by said command signal receiving and processing means of a command signal to FIRE causes said electrical energy stored in said charge storage device to discharge into said firing circuit, said base charge actuating if a voltage or current in said firing circuit resulting from discharge of said electrical energy from said charge storage device exceeds said threshold voltage or current, wherein the wireless command signal comprise radio waves.

2. The wireless detonator assembly of claim 1, further comprising a firing switch between the charge storage device and the base charge, as part of or in series with the firing circuit, the firing switch biased to an open position and switching to a closed position upon receipt by said command signal receiving and processing means of a signal to FIRE, thereby to cause said electrical energy to discharge from said charge storage device into said firing circuit, to actuate said base charge.

3. The wireless detonator assembly of claim 1, further comprising a charging switch between a power source and the charge storage device, said charging switch having an open position and a closed position, electrical contact being established between said power source and said charge storage device when said charging switch adopts said closed position, thereby to cause charging of said charge storage device.

4. The wireless detonator assembly of any one of claims 1, further comprising a discharging means to bleed charge from said charge storage device via any path except for said firing circuit.

5. The wireless detonator assembly of claim 4, wherein said discharging means comprises an earth.

6. The wireless detonator assembly of claim 1, said wireless detonator assembly further comprising:

a charging switch between the power source and the charge storage device, said charging switch having an open position and a closed position, electrical contact being established between said power source and said charge storage device when said charging switch adopts said closed position, thereby to cause charging of said charge storage device; and a discharging means to bleed charge from said charge storage device via any path except for said firing circuit;

wherein said charging switch is biased towards an open position such that said charge storage device discharges via said discharging means, and receipt of at least one "keep alive" command signal by said command signal receiving and processing means causes said charging switch to adopt a closed position; thereby to cause charging of said charge storage device.

7. The wireless detonator assembly of claim 6, wherein said "keep alive" command signal comprises a continuous signal transmitted by said blasting machine, said charging switch adopting an open position upon removal of, or in the absence of said continuous signal.

8. The wireless detonator assembly of claim 6, wherein said "keep alive" command signal causes said charging switch to maintain a closed position for a time period following receipt of said "keep alive" signal by said command signal receiving and processing means, said charging switch adopting an open position at the end of said time period unless said command signal receiving and processing means has received another "keep alive" signal from said blasting machine during said time period.

9. The wireless detonator assembly of claim 8, wherein said blasting machine transmits a series of "keep alive" signals to maintain said charging switch in said closed position so that the charge storage device remains at least substantially charged, said base charge being actuatable by discharge of said electrical energy into said firing circuit upon receipt of a command signal to FIRE.

10. The wireless detonator assembly of claim 6, wherein the discharging means is in electrical connection with the charging switch, such that when the charging switch is in an open position the charge storage device is connected to the discharging means but is not connected to the power supply thereby to cause bleeding of the charge in the charge storage device, and when the charging switch is in a closed position the charge storage device is connected to the power supply but is not connected to the discharging means thereby to cause charging of the charge storage device.

11. The wireless detonator assembly of claim 1, wherein the charge storage device is selected from the group consisting of: a capacitor, diode, rechargeable battery or activatable battery.

12. The wireless detonator assembly of claim 1, wherein the command signals are selected from the group consisting of: ARM signals, DISARM signals, FIRE signals, detonator delay times, and detonator firing codes.

13. The wireless detonator assembly of claim 1, further comprising signal transmission means for generating and transmitting at least one communication signal for receipt by the blasting machine.

14. The wireless detonator assembly of claim 13, wherein each communication signal comprises detonator delay times, detonator firing codes, or detonator status information.

15. The wireless detonator assembly of claim 1, wherein the wireless command signals comprise ULF radio waves.

16. The wireless detonator assembly of claim 1, wherein the wireless command signals comprise radio waves having a frequency of from 100 to 2000 Hz.

17. The wireless detonator assembly of claim 1, wherein the wireless command signals comprise radio waves having a frequency of from 200 to 1200 Hz.

18. The wireless detonator assembly of any of claim 1, wherein in use the base charge is located in a detonator shell down a borehole in association with an explosive charge, and at least said signal receiving and processing means, said charge storage device, and said power supply are located at or near a surface of the ground.

19. The wireless detonator assembly of claim 18, wherein at least said signal receiving and processing means, said charge storage device, and said power supply are located in a top-box at or near a surface of the ground.

20. The wireless detonator assembly of claim 1, wherein said at least one power source comprises an active power source to provide power at least to said signal receiving and processing means, and an energy receiving means for receiving energy from a remote energy source, said energy receiving means transferring said energy to a converting means for converting said energy to electrical energy, said converting means providing said electrical energy to charge said charge storage device.

21. The wireless detonator assembly of claim 20, wherein said remote energy source is a laser, said energy receiving means is a light capture device, and said converting means is a photodiode.

22. A wireless detonator assembly for use in connection with a blasting machine that transmits at least one wireless command signal to the wireless detonator assembly, the wireless detonator assembly comprising:

a detonator comprising a base charge;

command signal receiving and processing means for receiving and processing said at least one wireless command signal from said blasting machine;

a charge storage device for storing electrical energy at least one power source to power said command signal receiving and processing means, and to charge said charge storage device, said at least one power source supplying a maximum voltage or current that is less than a threshold voltage or current to actuate said base charge;

a firing circuit in electrical connection with said base charge;

a charging switch between a charging power source and the charge storage device, said charging switch having an open position and a closed position, electrical contact being established between said power source and said charge storage device when said charging switch adopts said closed position, thereby to cause charging of said charge storage device; and a discharging means to bleed charge from said charge storage device via any path except for said firing circuit, the discharging means being in electrical connection with the charging switch, such that when the charging switch is in an open position the charge storage device is connected to the discharging means but is not connected to the power supply thereby to cause bleeding of the charge in the charge storage device, and upon receipt by said command signal receiving and processing means of at least one "keep alive" command signal, said charging switch adopting a closed position such that the charge storage device is connected to the power supply but is not connected to the discharging means thereby to cause charging of the charge storage device;

whereupon receipt by said command signal receiving and processing means of a command signal to FIRE said electrical energy stored in said charge storage device is discharged into said firing circuit, said base charge actuating when a voltage or current in said firing circuit resulting from discharge of said electrical energy from said charge storage device exceeds said threshold voltage or current.

23. A blasting apparatus comprising:

at least one blasting machine capable of transmitting command signals to associated wireless detonator assemblies via wireless communications;

at least one explosive charge;

at least one wireless detonator assembly of claims 1 or claim 22 associated with each explosive charge and in wireless signal communication with said at least one blasting machine.

24. The blasting apparatus of claim 23 further comprising a central command station, said central command station transmitting command signals to said at least one blasting machine, said at least one blasting machine responding to said command signals or relaying said command signals to said at least one wireless detonator assembly.

25. A method of blasting at a blast site, the method comprising the steps of:

providing a blasting system according to claim 23;

placing a plurality of explosive charges at the blast site;

associating a wireless detonator assembly with each explosive charge such that actuation of each base charge will cause actuation of each associated explosive charge;

transmitting at least one "keep alive" command signal from said at least one blasting machine to each wireless detonator assembly, to cause each charging switch of each wireless detonator assembly to adopt a closed position, thereby to charge each charge storage device;

transmitting a FIRE signal from said at least one blasting machine to each wireless detonator assembly, to cause discharge of electrical energy from each charge storage device into each firing circuit, thereby causing actuation of each base charge.

26. The method according to claim 25, wherein the command signals further comprise delay times for each detonator, thereby to cause the detonators to fire in a specific timing pattern.

27. Use of the blasting system of claim 23, in a mining operation.

28. The method according to claim 25, wherein each detonator comprises a stored firing code, and the command signals further comprise firing codes, each detonator firing only if a stored firing code and a firing code from a command signal correspond.

29. Use according to claim 27, wherein the mining operation is an automated mining operation comprising robotic placement of explosive charges and wireless detonator assemblies at the blast site.

30. Use of the wireless detonator assembly of claim 1 or claim 22, in a mining operation.

31. Use according to claim 30, wherein the mining operation is an automated mining operation comprising robotic placement of explosive charges and wireless detonator assemblies at the blast site.

32. A wireless detonator assembly for use in connection with a blasting machine that transmits at least one wireless command signal to the wireless detonator assembly, the wireless detonator assembly comprising:

a detonator comprising a base charge;

command signal receiving and processing means for receiving and processing said at least one wireless command signal from said blasting machine;

a charge storage device for storing electrical energy;

at least one power source to power said command signal receiving and processing means, and to charge said charge storage device, said at least one power source supplying a maximum voltage or current that is less than a threshold voltage or current to actuate said base charge;

a firing circuit in electrical connection with said charge storage device; whereupon receipt by said command signal receiving and processing means of a command signal to FIRE causes said electrical energy stored in said charge storage device to discharge into said firing circuit, said base charge actuating when a voltage or current in said firing circuit resulting from discharge of said electrical energy from said charge storage device exceeds said threshold voltage or current; and a discharging means to bleed charge from said charge storage device via any path except for said firing circuit.

* * * * *